United States Patent [19]

Drits

[11] Patent Number: 4,816,965

[45] Date of Patent: Mar. 28, 1989

[54] MECHANISM FOR PROVIDING PULSED MAGNETIC FIELD

[75] Inventor: Vladimir Drits, Minnetonka, Minn.

[73] Assignee: Innovex Inc., Hopkins, Minn.

[21] Appl. No.: 55,781

[22] Filed: May 29, 1987

[51] Int. Cl.[4] ..... H01F 13/00; H01H 47/00

[52] U.S. Cl. ..... 361/267; 148/108

[58] Field of Search ..... 361/143, 144, 145, 267; 148/108

[56] References Cited

U.S. PATENT DOCUMENTS 3,164,753 1/1965 Schroeder ..... 361/145

*Primary Examiner*—L. T. Hix
*Assistant Examiner*—David Porterfield
*Attorney, Agent, or Firm*—Kinney & Lange

[57] ABSTRACT

A mechanically driven linkage causes a magnetic field acting on the object to be pulsed by alternately permitting and preventing a magnetic field from acting on the object during selected periods of time to relieve stress in the object or otherwise treat the object. Connections for applying a current through the object being treated are provided so that at the same the magnetic field is acting on the object a current added to affect the intermolecular structure of the object for various beneficial effects in treating. The current intensity and time cycle can be varied as desired and can be synchronized with the application of the magnetic field. Simple mechanical drives are used to selectively move the object or the magnetic field source, or to place a magnetic shield to block the field for selected periods of time, while permitting the magnetic field to act upon the object at other periods of time.

7 Claims, 3 Drawing Sheets

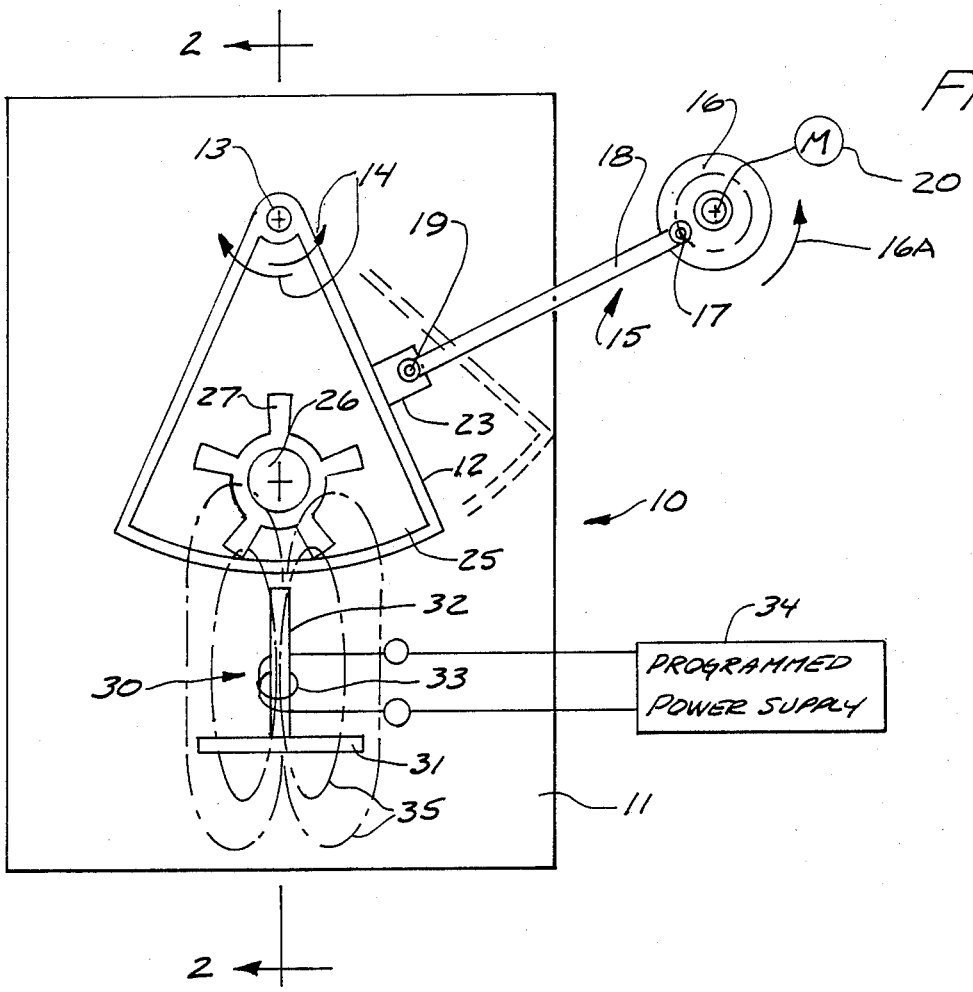
FIG. 1
FIG. 2
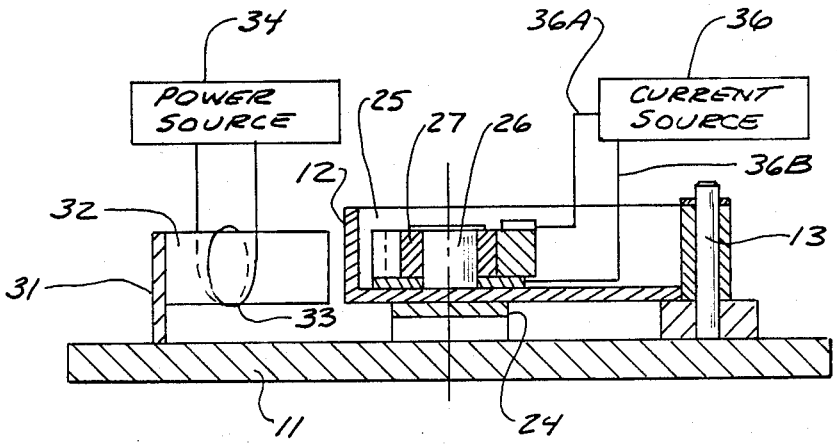

MECHANISM FOR PROVIDING PULSED MAGNETIC FIELD

CROSS REFERENCE TO RELATED APPLICATIONS

Reference is made to co-pending U.S. application Ser. No. 835,462, filed Mar. 3, 1986 for "A DEVICE FOR TREATMENT OF CUTTING TOOLS," and U.S. patent application Ser. No. 001,950, filed Jan. 9, 1987 for "A MAGNETIC TREATMENT OF FERROMAGNETIC MATERIALS."

BACKGROUND OF THE INVENTION

1. Field of the Invention

The present invention relates to treatment of objects in pulsed magnetic fields, primarily for redistributing the stresses in the object to improve the operating characteristics and useful life of such object.

2. Description of the Prior Art

In the prior art, various devices have been used for magnetizing and demagnetizing objects. For example, British Pat. No. 2,047,005 shows such a device, but does not teach pulsing the magnetic field, as needed in relieving stress in the object. In particular, this British patent does not teach the use of a period of substantially no magnetic field provided by a mechanical drive.

U.S. Pat. No. 4,537,850 illustrates a type of magnetic treatment aparatus as well.

SUMMARY OF THE INVENTION

The present invention relates to the treatment of objects that will respond to applied magnetic fields, and provides a device for pulsing a magnetic field, at the same time that a current is applied to the object. Of course, when current is applied, the object has to be an electrical conductor. The current can be varied for achieving desired levels of current intensity during the treatment.

The specific forms of the invention shown rely upon mechanical drives for causing pulsing of the magnetic field, and providing periods of time when no magnetic field is applied to the object, followed by intermittent applications of magnetic fields of a desired strength.

The application of current occurs simultaneously with the pulsing of the magnetic field. The part or object can be left magnetized or, subsequent to treatment, can be demagnetized if desired.

The device can take various simple forms as shown schematically. The schematic showings here are by way of illustration only.

BRIEF DESCRIPTION OF THE DRAWINGS

FIG. 1 is a schematic top plan view of an apparatus used for pulsing a magnetic field in relation to a part or object being treated, utilizing the principles of the present invention;

FIG. 2 is a sectional view taken on line 2—2 in FIG. 1;

DETAILED DESCRIPTION OF THE PREFERRED EMBODIMENTS

Figure 3:
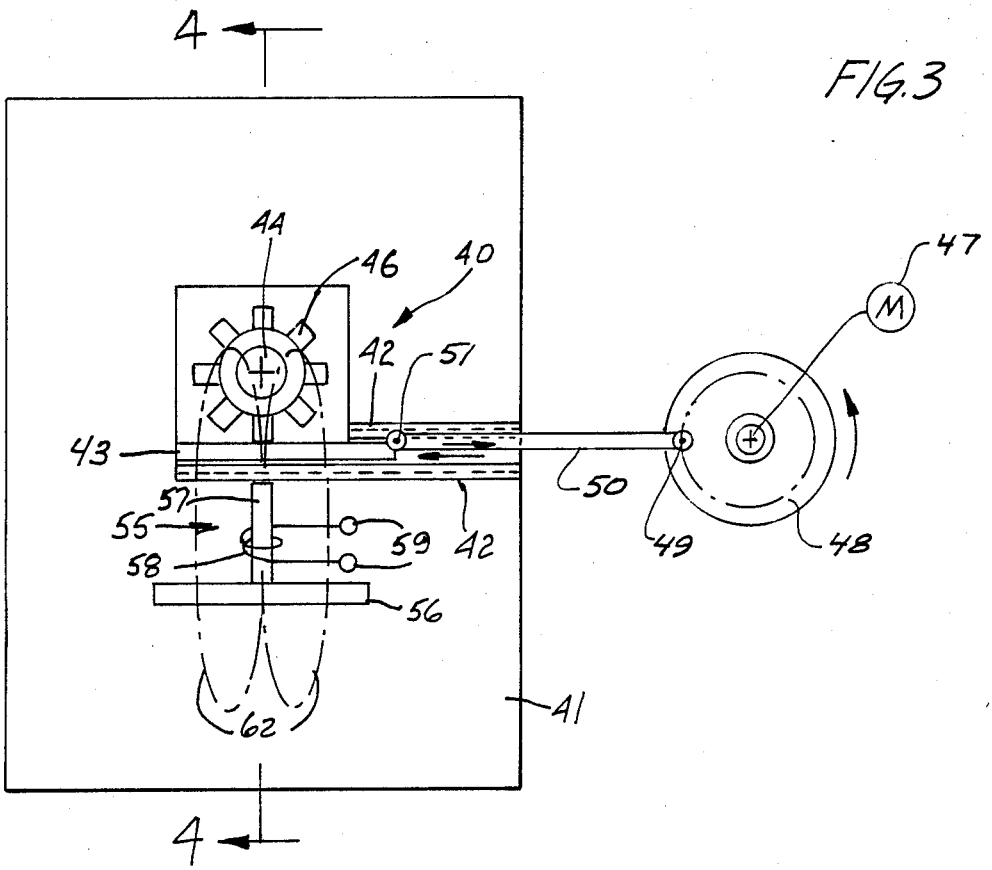
FIG. 3 is a top plan view of a modified form of the invention for permitting pulsing of an applied magnetic field on an object being treated.

Schematically shown in FIG. 1 is a magnetic treating apparatus indicated generally at 10 that includes a support table or frame 11, and a tray member 12 that is pivotally mounted on a pivot shaft 13 for movement about the axis of the shaft in transverse directions, or laterally, in an oscillating motion. This motion is indicated by the arrows 14, and can be obtained by use of a crank arrangement indicated generally at 15 that has a crank member 16 with a crank pin 17 that drives a connecting rod 18. The connecting rod 18 in turn is pivotally mounted as at 19 to a bracket 23 attached to the side of the tray 12. The tray 12 may be supported on a slide plate 24 fixed to frame 11.

The tray 12 has an interior chamber, indicated generally at 25 which has a mounting block or pin 26, on which an object or part 27 to be treated is mounted. This object 27 may be a part for a machine tool or a machine tool bit, or a load carrying part that has internal stresses and which may have its operating characteristics or useful life improved by treatment with a magnetic field.

Magnet means indicated generally at 30 can be an electromagnet using conventional or superconducting materials, or a strong permanent magnet. The magnet means, as shown, includes a support 31, a core 32, a coil 33, and a programmed power supply 34 connected to the coil. The programmed power supply 34 can be the same as that shown in the previously mentioned applications that are referenced in the background of the invention, and can provide a very strong continuous field, or even a continuously varying field, if desired. Magnetic flux lines represented generally at 35 are such that they will pass through the part or object 27 when the tray holding the object is positioned as shown in FIG. 1. The tray 12, of course, can be a magnetic field transparent material, which does not block or affect the magnetic field to any substantial degree.

Operating the crank 16 from a motor 20 to rotate as shown by the arrow 16A will cause the tray to be oscillated back and forth generally as shown by dotted lines to remove the effect of the magnetic field from the object, and provide a time of substantially no magnetic field effect on the object, in most portions of the object.

If the part or object is of ferromagnetic material, the magnetic field will affect the entire part and create stress relieving magnetic force on the interior molecular domains of the material.

The showing is schematic in FIG. 1, but the object 27 is moved substantially out of the influence of the magnetic field for a selected amount of time, which can be a dwell time if desired by stopping the motor 20. There can be continuous movement of the tray and object back and forth, as long as there is a break in the magnetic field forces that affect the object or part. This time of removal of the magnetic field can be a substantial reduction in the field, of course, as well as a time of complete absence of the magnetic field influence on the object.

The time cycle for applying and removal of the magnetic field can be selected as desired, but there will be magnetic field pulses passed through the object material, each followed by a time of substantially no magnetic field affecting the object or part.

In FIG. 2, connections for providing a current to the object or part 27 during the magnetic cycling are illustrated. As shown, a current source 36 is connected throught suitable leads 36A and 36B two different locations that are spaced apart on the object or part. The current can be an alternating current of desired frequency, or can be a DC current. The level of current through the object or part 27 is maintained at a desired level to further affect the overall impact on such a part during processing.

In the form shown, line 36B is attached to a contact that is supported at the hub of the object 27, while the line 36A is connected to the top surface of the part. In any event the connections to the lines carrying the current are positioned so that there is a current flow in the object itself.

Figure 4:
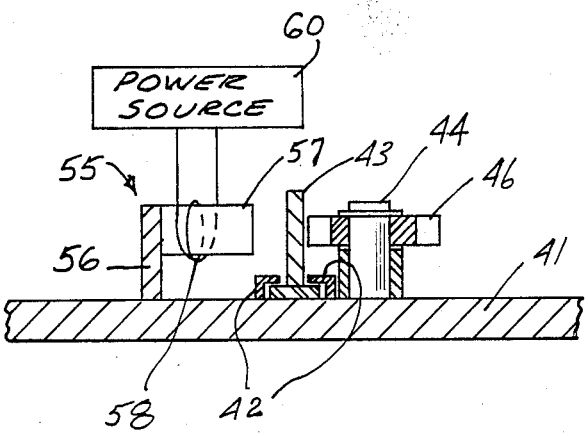
FIG. 4 is a sectional view taken as on line 4—4 in FIG. 3.

In the form of the invention shown in FIGS. 3 and 4, a magnetic treatment apparatus indicated generally at 40 is mounted on a frame or support plate 41, on which suitable guides 42 are mounted for supporting a wall 43. A mounting member or pin 44 is mounted on support plate 41. The pin 44 mounts a part or object 46 that is to be treated with a magnetic field flux.

A motor 47 is used for driving a crank 48, which has a crank pin 49 connected to a rod 50 that in turn is connected with a pin 51 to the wall 43, and causes the wall to reciprocate back and forth in the guide 42 a desired amount during operation.

Magnet means indicated generally at 55 is mounted onto the frame or support 41, and includes a support block 56 that has a core 57 mounted thereon. A coil 58 is used on the core and is connected through terminals 59 to a suitable power source 60 (see FIG. 4).

When the motor 47 is operating, and the power source 60 is on, the magnetic field indicated by flux lines 62 forms flux lines that will pass through the part unless blocked by wall 43, which is made of a magnetic material that shields the object or part 46. As the motor 47 operates, the wall 43 will be moved laterally to one side so the wall is out of the magnetic field of the magnet means and the field can pass through the object or part 46 for treating the object magnetically.

Here, again, there can be a pause at the end of the crank stroke so that the amount of time that the object or part 46 is in or out of the magnetic field can be controlled. The object or part 46 can be held in the magnetic field for a desired length of time by sliding the wall 43 to the side and then the wall can be reciprocated to block the magnetic field from the object 46. Mechanically cycling pulses the magnetic field effect on the object or part 46. This provides for stress relief, with a time dwell when substantially no magnetic field is present on the object or part 46 between pulses of magnetic field. A tray supporting the object or part 46 can be reciprocated into and out of the magnetic field.

Figure 5:
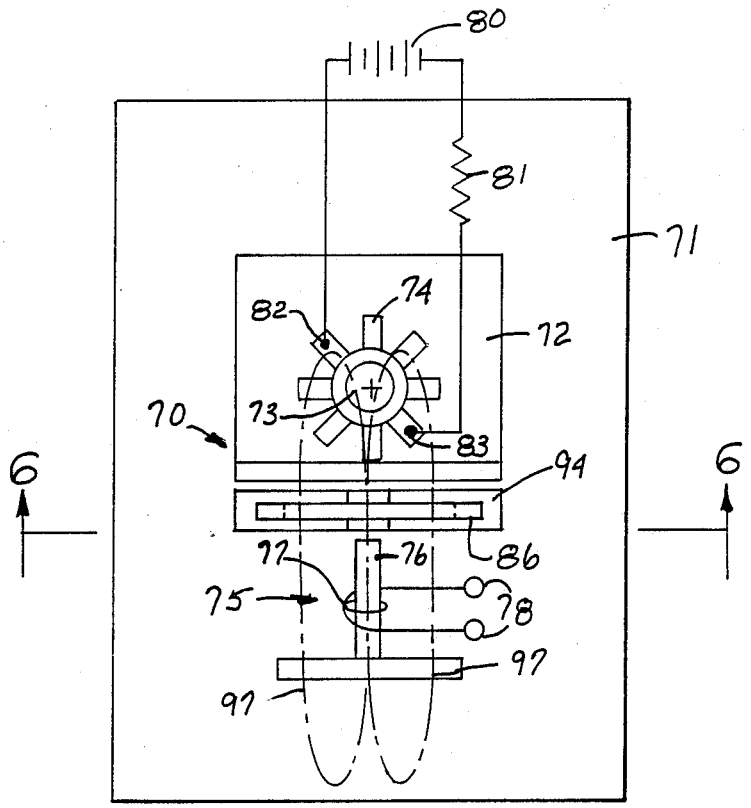
FIG. 5 is a top plan view of a further modified form of the invention showing means for pulsing a magnetic field applied to an object being treated.
Figure 6:
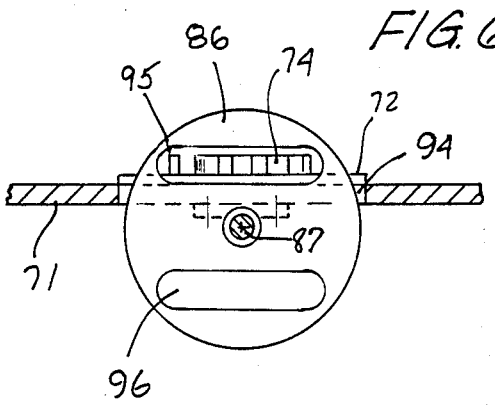
FIG. 6 is a sectional view taken as on line 6—6 in FIG. 5.
Figure 7:
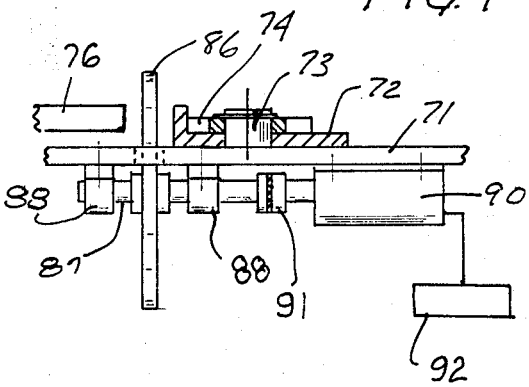
FIG. 7 is a part fragmentary sectional side view of the device of FIG. 6.

In FIGS. 5–7, a further schematic showing of another form of mechanically activated magnetic treatment apparatus indicated generally at 70 comprises a frame 71 that has a support 72 mounted thereon, which in turn has a pin 73 for mounting of an object or part 74. Magnet means 75 is mounted on the support 71, and comprises an electromagnet, or a permanent magnet as in the previous form of the invention. As shown, the magnet means 75 has a core 76, and a coil 77 that is connected to terminals 78 for connection to a power supply.

In this form of the invention, the magnetic field will affect the object 74 as shown, and a suitable current can also be passed through the object. For example, power source 80 is shown connected in series with a control resistor 81 that can be adjustable, to control current through the object at connections 82 and 83. Current can be applied simultaneously with the application of the magnetic field.

Additionally, the magnetic field can be varied or charged, in this form of the invention, by providing a rotating disc indicated generally at 86 made of a ferromagnetic material and mounted onto a shaft 87. The shaft 87 is mounted in suitable bearings 88 that are attached to the support 71, and a drive motor 90 is also mounted on the bottom of the support 71 that is coupled to the shaft 87 with a suitable drive coupling 91. The drive motor 90 has a suitable control 92 for starting and stopping the drive motor at desired positions, for example, with a quarter revolution or half revolution, or the motor 90 can be continuously rotating.

The disc 86 as shown extends through a slot 94 in support 71 and extends partly above the support 71. This part of the disc 86 is between the magnet means 75 and the part 74 has magnetic field transparent openings 95 and 96 therein, as shown, so that the magnetic field lines pass through the openings 95 and 96. When the ferromagnetic material of disc 86 is between the object 74 and the magnet means 75, the field shown at 97 is blocked. In this way, the control 92 can be made so that the field 97 is applied to the object 74 for a desired length of time, and then the disc 86 can be rotated to its desired position to block the field, also for a desired length of time. The power source 80 can be turned on at desired intervals, or can be continuous to apply a current to the object 74.

In all forms of the invention, magnetic field pulsing can be obtained by utilizing mechanical movement to pulse the magnetic field effect on the object or part. The forms shown are merely illustrative, but do not require programming the power source to the magnet in any manner. It is obvious that the magnet itself can be moved as well as the object or part. In other words, if a permanent magnet is used, it can be moved to and from locations where the magnetic field generated thereby affects the object or part being treated. For example, the magnet means can be attached to a support that slides like the wall 43 and is reciprocated in the same manner. Ferromagnetic materials can be used as blanking the field from time to time as shown in FIGS. 3–7.

The length of treatment can be varied by changing the speed of operation of the various mechanical devices, or having them turn on or off under a programmed control. Cycling is easily done with the controls that are shown.

The application of a current to the object or part can be beneficial for the operation of the unit regardless of how the magnetic field is pulsed. Again, the treatment is to have the magnetic field applied at a desired level, for a desired time, in sequence, with times of substantially no magnetic field being applied between the field applications. Very low levels of magnetic flux, of course, can be tolerated during the times of "no field" in relation to the maximum magnetic flux being applied during the main part of the treatment cycle.

The magnetic field strength, of course, has to be sufficient to affect the stresses in the material when stress reduction is desired. Additionally, if a coil is used for generating the magnetic field, and objects are placed on the interior of the coil, mechanical movement of the object into and out of the coil can be provided for reducing the effect of the magnetic field to a desired level of reduction. A sleeve also can be slid around an object on the interior of a core to block the magnetic field from the object being treated.

The concept includes the idea of cycling mechanically the magnetic field generated by magnet means when the object or part to be treated, such as a machine tool bit, is mounted on a tray on the interior of the coil.

Although the present invention has been described with reference to preferred embodiments, workers skilled in the art will recognize that changes may be made in form and detail without departing from the spirit and scope of the invention.

What is claimed is:

1. A treatment device for increasing the effective service life of an object subject to stress by stress equalization wherein the object is made of a material influenced by a magnetic field, comprising:

means for providing a magnetic field having sufficient strength to affect the internal domain of the molecules of the object;

means for supporting an object to be treated so as to be affected by the magnetic field at preselected times; and mechanical means for cycling the magnetic field effect on the object to be treated including means for moving the object out of the influence of the magnetic field to remove the effect of the magnetic field from the object for preselected periods of time, interspersed between times when the magnetic field affects a substantial portion of the object.

2. The apparatus as specified in claim 1 and means for passing an electrical current through said object at the same time the object is being treated in the cycle of use.

3. A treatment device for increasing the effective service life of an object subjected to stress by stress equalization wherein the object is made of a material influenced by a magnetic field, comprising:

means for providing a magnetic field having sufficient strength to affect the internal domain of the molecules of the object;

means for supporting an object to be treated so as to be affected by the magnetic field at preselected times; and mechanical means for cycling the magnetic field effect on the object to be treated by removing the effect of the magnetic field from the object for preselected periods of time, interspersed between times when the magnetic field affects a substantial portion of the object, said mechanical means comprising means for moving one of the object and the means for providing the magnetic field relative to the other.

4. The apparatus as specified in claim 3 wherein the means for supporting an object comprises a tray, means for movably mounting said tray, and the means for cycling comprises means for moving said tray and an object supported thereon into and out of the influence of the magnetic field from the means for providing.

5. The apparatus of claim 4 wherein the tray is pivotally mounted and the means for cycling comprises means for pivotally moving the tray.

6. A treatment device for increasing the effective service life of objects subjected to stress by stress equalization wherein the object is made of a material influenced by a magnetic field, comprising:

means for providing a magnetic field having a sufficient strength to affect stresses in the object;

means for supporting an object to be treated so as to be affected by the magnetic field at preselected times;

means for cycling the magnetic field effect on the object to be treated in time-related pulses of selected duration to reduce stresses in the object, and including a time between magnetic field effect pulses when the magnetic field effect is substantially reduced, said means for cycling the magnetic field comprising means for mechanically moving one of the object and the means for providing the magnetic field relative to the other; and means for providing a current through said object at the same time the magnetic field is being applied.

7. A treatment device for increasing the effective service life of an object subjected to stress by stress equalization wherein the object is made of a material influenced by a magnetic field, comprising:

means for providing a magnetic field having sufficient strength to affect the internal domain of the molecules of the object;

means for supporting an object to be treated so as to be affected by the magnetic field at preselected times;

mechanical means for cycling the magnetic field effect on the object to be treated by removing the effect of the magnetic field from the object for preselected periods of time, interspersed between times when the magnetic field affects a substantial portion of the object, said means for cycling the magnetic field comprising a movable tray for supporting one of the objects; and means for moving the tray to separate the object and the means for providing the magnetic field sufficiently to substantially eliminate the effects of the magnetic field on the object for preselected times.

* * * * *

UNITED STATES PATENT AND TRADEMARK OFFICE
CERTIFICATE OF CORRECTION

PATENT NO. : 4,816,965

DATED : March 28, 1989

INVENTOR(S) : Vladimir Drits

It is certified that error appears in the above-identified patent and that said Letters Patent is hereby corrected as shown below:

U.S. PATENT DOCUMENTS

| | | | |
|---|---|---|---|
| 1,978,220 | 10/1934 | Otte | 148/108 |
| 2,984,771 | 5/1961 | Hlavin | 361/149 |
| 3,138,494 | 6/1964 | Burket | 148/108x |
| 3,963,533 | 6/1976 | Collins | 148/108 |
| 4,273,800 | 6/1981 | Reid | 427/47 |
| 4,492,845 | 1/1985 | Kljuchko | 427/47 |
| 4,537,850 | 8/1985 | Smeiman | 430/137 |
| 4,668,365 | 5/1987 | Foster | 427/47 |

FOREIGN PATENT DOCUMENTS

| | | | |
|---|---|---|---|
| 2047005A | 11/1980 | United Kingdom | H01F/13/00 |

OTHER PUBLICATIONS

V.M. Finkel, "Physical Foundations of Failure Retardation", Moscow, "Metallurgiya" Publishers, 1977 (translated from Russian).

UNITED STATES PATENT AND TRADEMARK OFFICE

CERTIFICATE OF CORRECTION

PATENT NO. : 4,816,965

DATED : March 28, 1989

INVENTOR(S) : Vladimir Drits

It is certified that error appears in the above-identified patent and that said Letters Patent is hereby corrected as shown below:

Col. 5 line 18, delete "subject", insert -- subjected --

Signed and Sealed this

Fourteenth Day of November, 1989

*Attest:*

JEFFREY M. SAMUELS

*Attesting Officer* *Acting Commissioner of Patents and Trademarks*